United States Patent [19]

Bailey et al.

[11] 4,102,414

[45] Jul. 25, 1978

[54] DRILLING APPARATUS

[75] Inventors: Edward A. Bailey, Newport; James F. Ordway, West Lebanon, both of N.H.

[73] Assignee: Joy Manufacturing Company, Pittsburgh, Pa.

[21] Appl. No.: 712,622

[22] Filed: Aug. 9, 1976

[51] Int. Cl.[2] ..... B25B 23/00; E21B 19/00

[52] U.S. Cl. ..... 175/85; 81/57.16; 81/57.34

[58] Field of Search ..... 175/57, 85, 170; 269/25, 35, 256; 81/120, 125, 53 A, 57.33, 57.34, 57.35, 57.16; 285/39; 403/19, 307

[56] References Cited

U.S. PATENT DOCUMENTS

| | | | |
|---|---|---|---|
| 3,270,823 | 9/1966 | Buehler | 175/85 |
| 3,446,284 | 5/1969 | Dyer et al. | 175/85 |
| 3,463,247 | 8/1969 | Klein | 175/85 |
| 3,771,389 | 11/1973 | Coyne | 175/85 |
| 3,976,149 | 8/1976 | Granholm et al. | 175/85 |
| 3,980,143 | 9/1976 | Swartz et al. | 175/85 |

*Primary Examiner*—James A. Leppink
*Attorney, Agent, or Firm*—J. Stewart Brams

[57] ABSTRACT

A drilling apparatus adapted to have a drill string releasably secured thereto and including improved means for selectively locking such a drill string against axial rotation.

13 Claims, 5 Drawing Figures

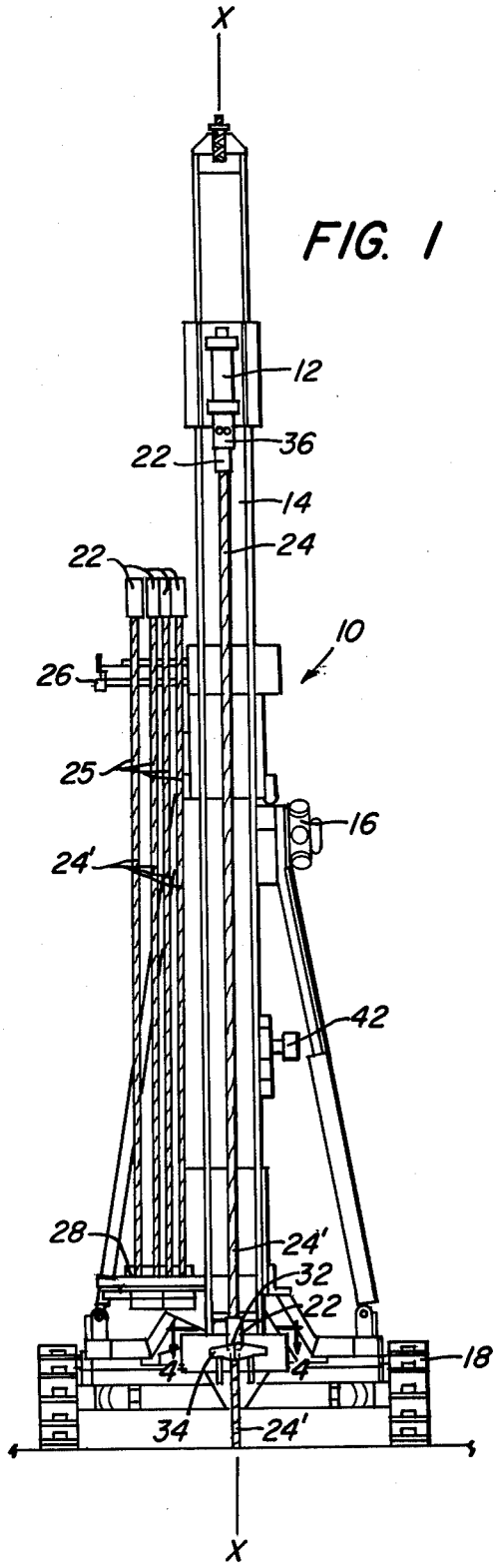
FIG. 1
FIG. 4
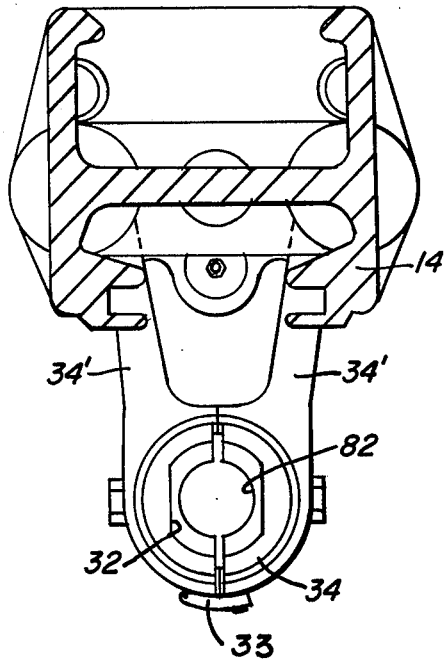

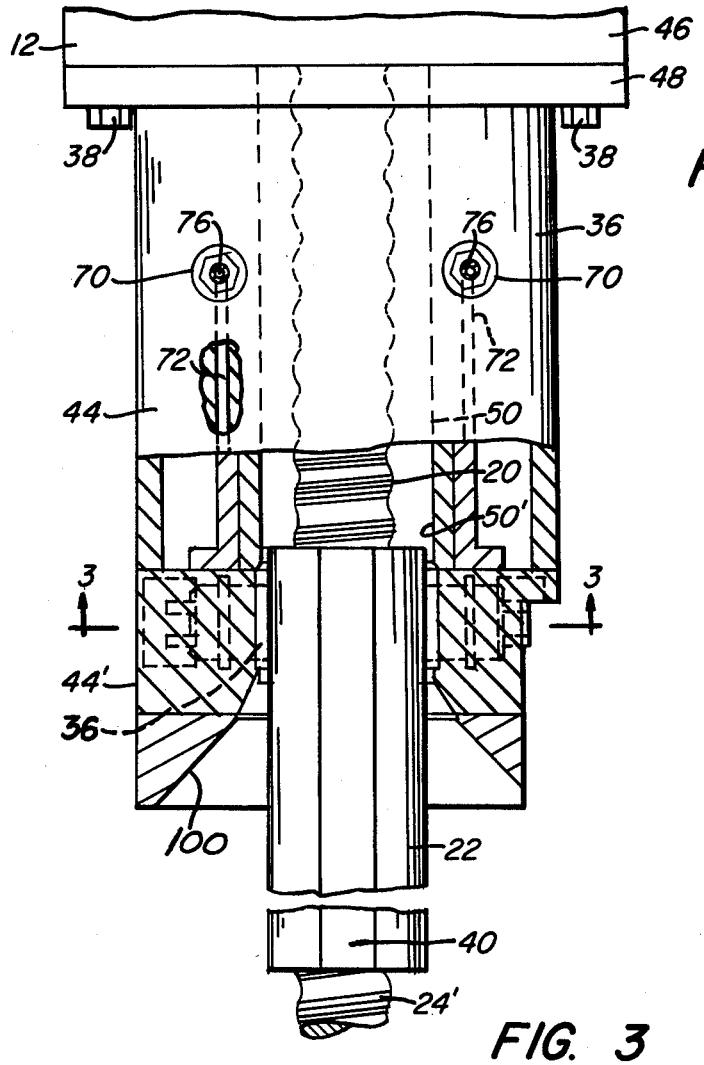
FIG. 2
FIG. 3
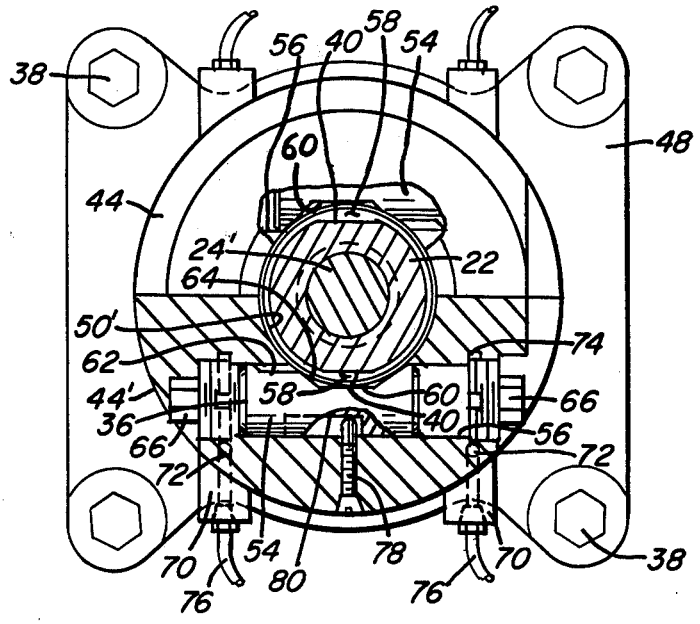

DRILLING APPARATUS

In the art of earth drilling it is well known to provide a drilling apparatus comprised of a mobile base carrying an elongated boom or mast which supports an elongated drill means including a drill motor carried for movement longitudinally of the boom and an elongated drill string operably engaged by the drill motor and extending forwardly therefrom parallel to the boom for drilling earth formations.

In many instances the holes to be drilled by such apparatus are required to be considerably deeper than the apparatus feed length and accordingly the drill string has commonly been assembled as drilling progresses by releasably securing a plurality of elongated drill rod sections end-to-end by coupling means. This requires considerable handling and manipulation of the drill rod sections annd coupling members, and the prior art has thus proposed various clamps, grips, wrenches, rod storage racks and the like to alleviate some of the rod handling difficulties inherent in such drilling procedures and to provide improved drilling efficiency and safety. Although such prior devices have generally served the purposes intended, they have been subject to various shortcomings. For example, many prior rod handling devices and methods have been limited to the use of uniform length rod sections. Some prior rod handling methods and apparatus have been unduly complex, and other such methods have provided drilling simplicity at the expense of safety or economic considerations.

The present invention provides an improved drill rod handling method and apparatus including a coupling lock means carried adjacent the front of the drill motor and movable therewith along the boom, and another coupling lock means spaced forwardly therefrom. Both coupling locks are cooperably engageable with improved rod coupling means to provide a drill string assembly and disassembly method which greatly simplifies rod handling. The present invention additionally provides improved drilling safety by its novel sequence of rod handling steps, and improved drilling versatility by permitting rod sections of varying lengths to be used in the same drill string.

These and other objects and advantages of the present invention are more fully specified in the following description with reference to the accompanying figures in which:

FIG. 1 is a front elevation of a mobile drilling apparatus including rod handling means constructed according to the principles of the instant invention;

FIG. 2 is a fragmentary portion of FIG. 1 illustrating one coupling lock of this invention with a forward end portion thereof partially cut away to illustrate a central longitudinal section thereof;

FIG. 3 is a partial transverse section of the coupling lock illustrated in FIG. 2 taken on line 3—3 of FIG. 2;

FIG. 4 is a fragmentary top plan view taken on line 4—4 of FIG. 1 to illustrate another coupling lock of the present invention.

Figure 5:
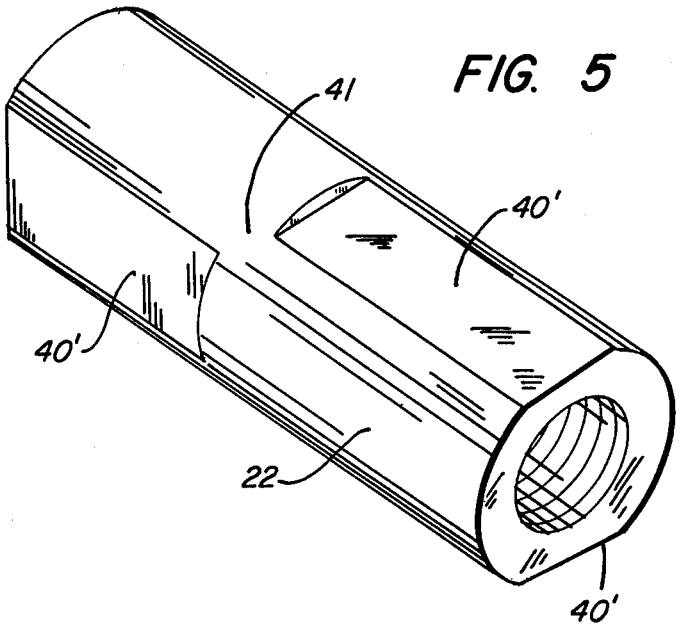
FIG. 5 is a perspective view of a coupling of this invention.

There is generally indicated at 10 in FIG. 1 an earth drilling apparatus including drill rod handling or manipulating means constructed according to the principles of the instant invention. Drill 10 comprises a drill motor or actuator 12 such as a combined rotation and linear percussion motor powered by any suitable motive power means (not shown) and mounted for selectively controllable movement longitudinally of a generally upstanding elongated boom or mast 14 by suitable feed means such as a feed chain mechanism partially shown at 16 and cooperable with boom 14 for feeding motor 12 upwardly and downwardly therealong as viewed in FIG. 1. Boom 14 is pivotally adjustably carried by a suitable mobile base such as a powered crawler frame 18 for selective traverse of the ground to position drill 10 for drilling.

Drill motor 12 includes a forwardly or downwardly extending elongated striking bar 20 (FIG. 2) to which there is coaxially secured by an elongated reversible coupling sleeve 22 an elongated forwardly extending drill string 24 ordinarily comprised of a plurality of drill rod sections 24' rigidly releasably secured end-to-end by other coupling members 22. A conventional drill bit (not shown) is rigidly releasably affixed to the forwardmost end of the drill string 24 for drilling a bore hole along axis X—X in a well known manner.

The rod sections 24' are shown as continuously externally threaded rods engagable in forceful axial abutment adjacent their longitudinal ends by being cooperably threaded into inner peripheral portions of coupling sleeves 22 such that the sleeves 22 are maintained in axial tension as is well known; however, it will be understood that various other rod and coupling configurations are suitable for the purposes of the instant invention. For example the rod sections 24' need not be continuously threaded, and other means of securing the couplings 22 to rods 24' may be employed (e.g. a bayonet lock).

Inasmuch as the drill 10 generally described hereinabove is well known to those versed in the art further detailed description thereof is omitted herefrom; however, it will be understood that drill 10 is but one of numerous drilling rigs adapted to employ the invention hereinbelow described, and accordingly reference thereto should not be construed as limiting on the invention. For purposes of the description hereinbelow the term longitudinal will refer to the direction of the longitudinal extent of boom 14 and the terms lateral and transverse will refer to directions lateral and transverse to such longitudinal extent.

To facilitate handling and storing the individual drill rod sections 24' during drill string assembly and disassembly, drill 10 is provided with any suitable drill rod storage rack 26 (FIG. 1) carried by boom 14 and adapted to carry a plurality of drill rod sections 24' therewithin in generally parallel orientation to the longitudinal extent of boom 14. The structure or rack 26 permits drill rod sections 24' carried thereby to be moved laterally with respect to boom 14 to selectively coaxially align rod sections 24' with axis X—X as is well known. Preferably, rod sections 24' are engaged and supported adjacent their lower ends within a lower rod end receiving portion 28 of rack 26 and secured therein adjacent their upper ends in a manner such that the rod sections 24' may be laterally removed from and inserted into rack 26 with only minimal vertical motion being required. This facilitates drill string assembly and disassembly as described hereinbelow.

A drill rod gripping means 42 is adjustably carried intermediate the longitudinal ends of boom 14 for tightly gripping the laterally adjacent portion of a drill rod section 24' in drill string 24. Grip 42 includes means to selectively move a gripping jaw portion thereof laterally into or out of engagement with the drill string 24 as more fully described and claimed in copending U.S. application Ser. No. 657,508 which was filed Feb. 12, 1976 and is assigned to the same assignee as the instant invention.

The drill 10 additionally includes a forward drill rod centralizer 34 (FIG. 4) which extends laterally outward of the forward end of boom 14 to support and guide drill string 24. The centralizer 34 has a pair of laterally pivotal arms 34' which are concomitantly pivotal to an engaged position as shown in FIG. 4 whereat the laterally outer ends thereof form a guide bore 82 coaxial with axis X—X and of a diameter to slidably receive rod section 24' therewithin. In the engaged position thereof, the arms 34' also form a stationary, upwardly open coupling lock or restraining means in the form of a socket wrench 32 coaxially upwardly of guide bore 82 whereby the lock 32 is engagable with cooperably formed wrench flats 40 extending axially on the periphery of each coupling sleeve 22 and described in detail hereinbelow. Since coupling sleeve 22 cannot pass through bore 82, centralizer 34 may be disengaged or opened by pivoting arms 34' laterally outward from axis X—X, as for example when a sleeve 22 must pass by the centralizer 34 during drilling. Any suitable manual or powered latch means such as a latch 33 may be provided to selectively secure arms 34' in the engaged position thereof.

A rearward coupling lock or restraining means 36 (FIGS. 1, 2 and 3) is stationary with respect to drill motor 12 and preferably is secured adjacent the forward end of drill motor 12 and extends coaxially forwardly therefrom. Coupling lock 36 comprises an elongated annular housing 44 rigidly releasably affixed adjacent the forward end of drill motor 12 by a plurality of threaded fasteners 38 passing through a respective plurality of aligned bores in adjacent flange portions 46, 48 of motor 12 and housing 44, respectively. The striking bars 20 extends coaxially forwardly of the motor 12 within a forwardly open coaxial bore 50 formed within housing 44 and having a forward end portion 50' of a sufficiently large diameter to receive axially therewithin a coupling sleeve 22 for threaded engagement with striking bar 20. The opposed axial end of such sleeve 22 is threadedly engagable with the upper or rearward end of a drill rod section 24' to rigidly releasably secure the rod section 24' to striking bar 20. A forward end portion 44' of housing 44 within which bore portion 50' is defined includes coupling lock means comprised of a pair of identical elongated, generally cylindrical piston members 54 concomitantly slidably disposed within a respective pair of parallel, laterally spaced and transversely extending bores 56 formed within housing portion 44' (FIG. 3) adjacent diametrically opposite sides of bore portion 50' such that zones of mutual intersection 58 are defined by the bore 50' and respective bores 56. The axial ends of each bore 56 are closed as by plugs 66 threadedly and sealingly engaged therewithin to define chambers adjacent the respective axial ends of each piston 54 for fluid actuation thereof as described hereinbelow.

Each piston 54 includes an axially and radially inwardly extending cavity 60 intermediate the axial ends thereof which conforms generally to the cross sectional profile of bore portion 50' within zones 58 such that each piston 54, when located at one extreme axial position thereof in its respective bore 56, lies entirely outside bore portion 50' and the coupling lock 36 is thus disengaged from a coupling 22 located in bore portion 50'. Each piston 54 further includes locking flats 62 extending axially adjacent the cavity 60 for engaging the longitudinally extending wrench flats 40 on coupling sleeve 22 when pistons 54 are moved to the opposite extreme or engaged position thereof within bores 56 to lock the respective sleeve 22 against reverse rotation (i.e. the rotation direction of striking bar 20 which will disengage the threaded connection between the striking bar and a non-rotating coupling, taken as counterclockwise rotation in FIG. 3). In practice coupling 22 may not necessarily be aligned for engagement of flats 40 by flats 62 and the drill motor is thus slowly reverse rotated simultaneously with urging of pistons 54 toward their engaged positions to ensure positive engagement of flats 40 and 62 when proper alignment is achieved. With pistons 54 positioned as described for locking action, the coupling 22 is still free for forward (clockwise) rotation during which flats 40 repeatedly disengage flats 62 by engaging an inclined end portion 64 of cavity 60 adjacent flats 62 to push the respective pistons 54 toward the illustrated disengaged position thereof. Thus lock 36 as shown is operative to lock couplings 22 only against reverse drill string rotation. Of course lock 36 may be readily adapted to lock couplings 22 against both forward and reverse rotation by providing suitable modifications such as extending flats 62 or interchanging the positions of flats 62 and portion 64 on one of pistons 54.

To prevent misalignment of flats 62 and cavity 60 with bore portion 50' and the coupling 22 therewithin, a guide pin 78 is removably secured within body 44 and extends radially into each bore 56 and within a longitudinally extending groove 80 formed intermediate the axial ends of each respective piston 54 to constrain the pistons 54 against axial rotation.

To move pistons 54 intermediate the described engaged and disengaged positions thereof fluid actuating means are provided comprising four fluid passageways 72 extending within the outer peripheral wall of housing 44 and each communicating adjacent one end thereof with the exterior of the housing 44 via a respective port 70. The opposite end of each respective passageway 72 is in fluid communication with one axial end of one bore 56 via four respective radially outwardly extending annuli 74, one annulus 74 encompassing each end of each bore 56. Fluid conducting conduits 76 suitably secured to ports 70 by conventional fittings and communicating with any suitable fluid pressure source and valve means (not shown) external to housing 44 selectively conduct motive fluid to the axial ends of bores 56 to act on pistons 54 for selective urging thereof toward the described engaged and disengaged positions. Of course it is not necessary that a separate fluid port 70 and conduit 76 be provided to conduct fluid to each end of each bore 56 inasmuch as the pistons 54 are intended to be concomitantly movable at all times for simultaneous engagement and disengagement with a coupling 22. Accordingly, a single pair of fluid ports 70 may be employed to direct motive fluid via any suitably formed communicating passageways to the respective ends of both bores 56 to provide motive fluid for concomitantly actuating the respective pistons 54. Other piston actuating means may be employed, for example the combination of a single fluid pressure means to act on one end of each piston 54 and a positive spring bias return mechanism to act on the opposite end thereof, or a spring loaded electric solenoid device.

In practice the drill string 24 is made up as drilling proceeds from individual rod sections 24', each having a coupling sleeve 22 threadedly secured to the upper end thereof, and jointly referred to hereinafter as rod assemblies 25. During drilling the motor 12 is conventionally actuated and fed forwardly or downwardly along boom 14 to drive a borehole with a previously made-up portion of drill string 24 to the full depth permitted by opening centralizer 34. Motor 12 is raised sufficiently that centralizer 34 may be closed, and is then lowered as drill string 24 is slowly rotated to align and engage flats 40 of the uppermost coupling 22 within lock 32. Motor 12 is then actuated in reverse rotation to disengage striking bar 20 from the locked coupling 22, and retracted to its uppermost position for insertion of the next rod assembly 25 carried by rack 26 while the drill string remains suspended in the bore hole from centralizer 34. Accordingly, rack 26 is moved to coaxially align the next assembly 25 with axis X—X for engagement of the coupling 22 thereon with striking bar 20 by downward feeding and forward rotation of motor 12. The new assembly 25 is then lifted from rack portion 28 by upward retraction of motor 12 to clear the rack 26 which is then moved laterally aside. Assembly 25 is then lowered and forwardly rotated into threaded engagement with the uppermost coupling 22 of the assembled drill string 24 which has remained engaged within lock 32. Continued forward rotation of motor 12 tightly engages all threaded connections between the lock 32 and the striking bar 20 whereupon centralizer 34 is opened to allow continued drilling in the conventional manner. During the hereinabove described drill string make-up procedure the forward funnel shaped inner periphery 100 of housing 44 guides the newly added assembly 25 into engagement with striking bar 20 for make-up of the threaded connection therebetween.

For disassembly of the drill string 24, all threaded connections in drill string 24 are loosened slightly by mechanically jarring the drill string in any convenient way, for example by percussive blows with the percussion hammer piston in motor 12 without drill string rotation and with the bit on the bottom of the bore hole. With all threaded connections loosened motor 12 is retracted upwardly to withdraw the uppermost assembly 25 from the bore hole to a position whereat the second coupling 22 (connecting the first and second drill rod sections) is located above centralizer 34. Gripper 42 is then actuated to grip the rod portion of uppermost assembly 25 against axial rotation thereof and motor 12 is actuated in forward rotation to tightly engage the threaded connections of the uppermost coupling 22 only. Grippers 42 then releases the drill rod and, with centralizer 34 closed, motor 12 is lowered and slowly reverse rotated as needed to engage flats 40 of the next lower (second) coupling 22 within lock 32. Inasmuch as all threaded connections except those of the uppermost coupling 22 are loose, further reverse rotation disengages the uppermost assembly 25 from the coupling 22 engaged in lock 32 and the remainder of the drill string remains suspended from centralizer 34 in the bore hole. Next, motor 12 is retracted upwardly to lift the assembly 25 suspended therefrom a sufficient distance for rack 26 to be positioned to receive the lower end thereof, and lock 36 is actuated as described hereinabove to engage flats 40 of upper coupling 22 during reverse rotation of motor 12. Striking bar 20 thus disengages coupling 22 and the assembly 25 drops a short distance into rack portion 28 with the coupling 22 dropping clear of lock 36. Rack 26 is then actuated to secure the assembly 25 adjacent its upper end and to transport the assembly 25 laterally from axis X—X. Lock 36 is returned to its disengaged position and the motor 12 lowered and forwardly rotated as necessary to threadingly engage striking bar 20 with the uppermost coupling 22 of the drill string 24 which has remained engaged within lock 32. The above procedure is repeated until the drill string is entirely withdrawn from the bore hole and disassembled.

For purposes of the invention described hereinabove various arrangements of wrench flats on coupling 22 may be employed although the longitudinally continuous, open ended flats 40 are preferred for manufacturing economy. For example longitudinal sets of independent wrench flats 40' may extend from each axial end of the couplings 22 thus leaving an axially intermediate coupling portion 41 with no flats whatsoever (FIG. 5). Such independent flats 40' may be circumferentially aligned or non-aligned as desired. Likewise, more than two flats or other engagable surface configurations may be employed, along with suitably modified coupling locks. In all such alternative structures, however, the engageable coupling surface portions must permit axial engagement and disengagement with either of locks 32 or 36 so that it will be possible to either lower a coupling 22 vertically into lock 32 or to allow an assembly 25 to drop vertically clear of lock 36 into disengagement thereof from striking bar 20. Furthermore, the axial extent of engagable surface portions on at least one end of the reversible coupling must be sufficient to permit engagement thereof within lock 36 throughout the full run of threaded engagement between coupling 22 and striking bar 20, and additionally throughout the entire range of any axial play between lock 36 and a coupling secured to striking bar 20. For example striking bar 20 may have a range of axial free play with respect to motor 12 which must be accounted for in determining the required lengths of flats 40.

By the invention described hereinabove there is provided means for handling drill rod sections during assembly and disassembly of elongated drill string made up of a plurality of such rod sections secured end-to-end by novel coupling means. Longitudinally spaced lock means, one of which is carried by the drill motor, are engagable with the novel coupling means to facilitate drill string assembly and disassembly.

Inasmuch as the description hereinabove pertains to a preferred embodiment of the invention, various altenative or modified embodiments will readily occur to those versed in the art. For example, the assemblies 25 may alternatively by unitary drill string elements or more particularly, rod sections with respective integral male and female thread connections such as conventional drill pipe pin and box arrangements with wrench flats formed as required axially adjacent such pin and box portions; if desired lower lock 32 may be independent of the forward centralizer 34; the configuration and operation of rack 26 may be varied within a wide design latitude; and the like.

These and other embodiments and modifications having been envisioned and anticipated by the inventors it is respectfully submitted that the invention should be construed broadly and limited only by the scope of the claims appended hereto.

what is claimed is:

1. A drilling apparatus comprising:

a drill means including an elongated drive portion adapted to have a coupling portion of an elongated drill string secured thereto;

a selectively operable restraining means for restraining such coupling portion from rotation with respect to said drill means;

said restraining means including a body member fixedly located with respect to said drill means adjacent said drive portion, and elongated lock means carried by said body member;

said lock means being oriented with a longitudinal extent thereof extending transversely of the axial extent of said drive portion and being selectively axially movable to engage and disengage such a coupling portion for selectively restraining such coupling portion from rotation with respect to said drill means.

2. A drilling apparatus as claimed in claim 1 wherein said lock means includes elongated generally cylindrical means extending transversely of the axial extent of said drive portion; said cylindrical means being movable in opposite axial directions to respective engaged and disengaged positions thereof.

3. A drilling apparatus as claimed in claim 2 wherein said generally cylindrical means is a pair of cylindrical members each extending transversely of the axial extent of said drive portion and each being movable in opposite axial directions to said respective engaged and disengaged positions thereof.

4. A drilling apparatus as claimed in claim 3 wherein at least one of said pair of cylindrical members is axially slideably carried by said body member and said at least one cylindrical member includes actuatable means adjacent the opposite axial ends thereof; said actuatable means being adapted to be actuated by motive means for such moving of said one cylindrical member in opposite axial directions.

5. A drilling apparatus as claimed in claim 1 wherein said restraining means is selectively operable to lock such secured coupling against axial rotation in one rotary direction only.

6. A drilling apparatus as claimed in claim 1 additionally including guide means for guiding such coupling portion into engagement with said drive portion to facilitate securing of such coupling portion to said drive portion.

7. A drilling apparatus as claimed in claim 6 wherein said guide means includes a conical surface means axially encompassing said drive portion for axially receiving such coupling portion into coaxial alignment with said drive portion upon moving such coupling portion axially into proximity with said drive portion.

8. A drilling apparatus as claimed in claim 7 wherein said body member includes an annular portion encompassing said drive portion and said conical surface means is a conical inner pheripheral surface portion of said annular body portion.

9. In a drilling apparatus the combination comprising: an elongated boom; a drill means including a drive portion thereof adapted to have an elongated drill string secured thereto; said drill means being movable longitudinally of said boom for moving such drill string axially thereof; a pair of lock means operable to engage axially spaced portions of such drill string to secure selected portions of such drill string against axial rotation thereof with respect to said drill means; one of said lock means being axially and rotationally stationary with respect to said drill means and the other of said lock means being axially movable with respect to said drill means.

10. The combination as claimed in claim 9 additionally including gripping means for engaging intermediate portions of such drill string axially intermediate said pair of lock means to secure such intermediate portions against axial rotation thereof with respect to said drill means.

11. The combination as claimed in claim 9 wherein said other lock means is axially stationary with respect to said boom.

12. The combination as claimed in claim 11 wherein said one lock means is movable axially of said boom concomitantly with said drill means.

13. The combination as claimed in claim 12 wherein said one lock means is carried by said drill means and is operable to engage a portion of such drill string adjacent said drive portion.

* * * * *

UNITED STATES PATENT OFFICE

CERTIFICATE OF CORRECTION

PATENT NO. : 4,102,414

DATED : July 25, 1978

INVENTOR(S) : Edward A. Bailey and James F. Ordway

It is certified that error appears in the above-identified patent and that said Letters Patent are hereby corrected as shown below:

In Column 1, line 19 delete "annd" and insert --and--.

In Column 6, line 50 delete "altenative" and insert --alternative--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*